US007367641B2

(12) United States Patent
Jeong

(10) Patent No.: US 7,367,641 B2
(45) Date of Patent: May 6, 2008

(54) METHOD OF DRIVING A PRINT HEAD AND IMAGE FORMING DEVICE EMPLOYING THE METHOD

(75) Inventor: Jin-wook Jeong, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 144 days.

(21) Appl. No.: 11/333,263

(22) Filed: Jan. 18, 2006

(65) Prior Publication Data

US 2006/0158471 A1 Jul. 20, 2006

(30) Foreign Application Priority Data

Jan. 20, 2005 (KR) ..... 10-2005-0005407

(51) Int. Cl.
*B41J 2/205* (2006.01)

(52) U.S. Cl. ..... 347/12; 347/15

(58) Field of Classification Search ..... 347/12, 347/15, 43, 41; 358/1.2, 1.9, 3.23
See application file for complete search history.

(56) References Cited

U.S. PATENT DOCUMENTS 6,130,685 A 10/2000 Matsubara et al.
6,655,783 B2 12/2003 Otsuki
6,682,171 B2 1/2004 Otsuka
2002/0067393 A1 * 6/2002 Kanda et al. ..... 347/41

FOREIGN PATENT DOCUMENTS

| | | |
|---|---|---|
| CN | 1530229 | 9/2004 |
| JP | 08-238805 | 9/1996 |
| JP | 09-220819 | 8/1997 |
| JP | 11-042769 | 2/1999 |
| JP | 2004-082555 | 3/2004 |

* cited by examiner

*Primary Examiner*—Lamson Nguyen
(74) *Attorney, Agent, or Firm*—Roylance, Abrams, Berdo & Goodman, L.L.P.

(57) ABSTRACT

A method of driving recording elements of a print head in an image forming apparatus for printing an image on media, for example, nozzles ejecting ink on the media in an inkjet printer, and an image forming apparatus employing the method are provided. The method includes: obtaining, for each of a plurality of drive tables, a maximum number of recording elements to be simultaneously driven when printing the image, according to a drive order in each of the plurality of drive tables, each drive table comprising drive order information about the order of driving the recording elements; selecting the drive table of the plurality of tables in which the obtained maximum number of the recording elements to be simultaneously driven is smallest; and driving the recording elements using the selected drive table.

15 Claims, 5 Drawing Sheets

METHOD OF DRIVING A PRINT HEAD AND IMAGE FORMING DEVICE EMPLOYING THE METHOD

CROSS-REFERENCE TO RELATED PATENT APPLICATION

This application claims the benefit under 35 U.S.C. §119 (a) of Korean Patent Application No. 2005-0005407, filed on Jan. 20, 2005, in the Korean Intellectual Property Office, the entire disclosure of which is hereby incorporated by reference.

BACKGROUND OF THE INVENTION

1. Field of the Invention

The present invention relates to an image forming device. More particularly, the present invention relates to a method of analyzing electric power to be consumed when printing a page prior to the page being printed and driving recording elements of a print head using the result of the analysis, and an image forming device employing the method.

2. Description of the Related Art

In general, an image forming device converts a document from an application program or an image from a digital camera into encoded data and outputs the data onto physical media.

Recently, image forming devices having an array head structure have been developed. Image forming devices having an array head structure print at higher speeds because they do not have a print head that moves from side to side. Instead, they use a print head that is as long as the media is wide. Image forming devices having the array head structure typically has many recording elements included in the print head to print an image to the media.

In an inkjet printer, a print head has a plurality of nozzles that eject ink onto the media to print an image. It is desired that fixed level of electric power be supplied so that the respective nozzles eject ink onto the media.

However, in an image forming device having the array head structure, such as an inkjet printer, the amount of electric power consumed for printing varies according to the number of recording elements used. Further, the amount of electric power consumed for printing varies according to the characteristics of the image being printed. Therefore, because the number of recording elements used varies and characteristics of images to be printed differ, power may not be stably supplied.

Accordingly, there is a need for an improved method for driving a print head with reduced power consumption that is not significantly influenced by characteristics of an image to be printed and thus stably drive the power supply device.

SUMMARY OF THE INVENTION

An aspect of the present invention is to address at least the above problems and/or disadvantages and to provide at least the advantages described below. Accordingly, an aspect of the present invention is to provide a method of driving a print head that make it possible to print an image with reduced power consumption that is not significantly influenced by characteristics of an image to be printed and an image forming device employing the method. The method is carried out by selecting a drive table having the lowest power consumption for image data to be printed from among a plurality of drive tables having information about the drive order of recording elements and thus driving the recording elements to print an image with a print head having a plurality of recording elements.

According to an aspect of the present invention, there is provided a method of driving a print head, the method comprising: obtaining, for each of a plurality of drive tables, a maximum number of the recording elements to be simultaneously driven when printing the image, according to a drive order in each of the plurality of drive tables, each drive table comprising drive order information about the order of driving the recording elements. The method further comprises selecting the drive table of the plurality of tables in which the obtained maximum number of the recording elements to be simultaneously driven is smallest, and driving the recording elements using the selected drive table. The print head may be a line array head Further, the recording elements may print an image by ejecting ink on the media.

The at least one of the plurality of drive tables is a drive table having drive order information for driving the recording elements so that a distance between adjacent recording elements to be simultaneously driven becomes N times further than a distance between adjacent recording elements.

The at least one of the plurality of drive tables is a drive table having drive order information so that at different times four recording elements are driven to print the respective cyan C, magenta M, yellow Y, and black K colors in the same printing position.

The at least one of the plurality of drive tables is a drive table having drive order information so that in the same printing position two recording elements are simultaneously driven to each print cyan C and magenta M colors in and another two recording elements are simultaneously driven to each print yellow Y and black K colors.

The method of driving a print head may further include increasing the number N of the drive groups when the maximum number of recording elements to be simultaneously driven in the selected drive table exceeds a predetermined number.

According to another aspect of the present invention, there is provided an image forming apparatus comprising: a data input unit for receiving image data to printed; a controller for generating and outputting control signals for dividing the recording elements into the N number of drive groups and sequentially driving the N groups of recording elements, depending on the input data; and the print head having the plurality of recording elements for printing an image on media by driving the recording elements according to the control signals.

The controller may include a memory storing a plurality of drive tables having drive order information about the order of driving the recording elements and image data; a calculator reading the image data from the memory and calculating, for each of the plurality of drive tables, a maximum number of recording elements to be simultaneously driven when printing the image, according to the drive order in each of the plurality of drive tables stored in the memory; and a table selector selecting a drive table in which the calculated maximum number of recording elements to be simultaneously driven is the smallest. The print head may be a line array head. The recording elements may print an image by ejecting ink on the media.

The at least one of the plurality of drive tables is a drive table having drive order information for driving the recording elements so that a distance between adjacent recording elements to be simultaneously driven becomes N times further than a distance between adjacent recording elements.

The at least one of the plurality of drive tables is a drive table having drive order information so that at different times four recording elements are driven to print the respective cyan C, magenta M, yellow Y, and black K colors in the same printing position.

The at least one of the plurality of drive tables is a drive table having drive order information so that in the same printing position two recording elements are simultaneously driven to each print cyan C and magenta M colors in and another two recording elements are simultaneously driven to each print yellow Y and black K colors.

The image forming device may further include increasing the number N of the drive groups when the maximum number of recording elements to be simultaneously driven in the selected drive table exceeds a predetermined number.

The method of driving a print head may be embodied on a computer readable recording medium on which a program for executing it in the computer is recorded.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
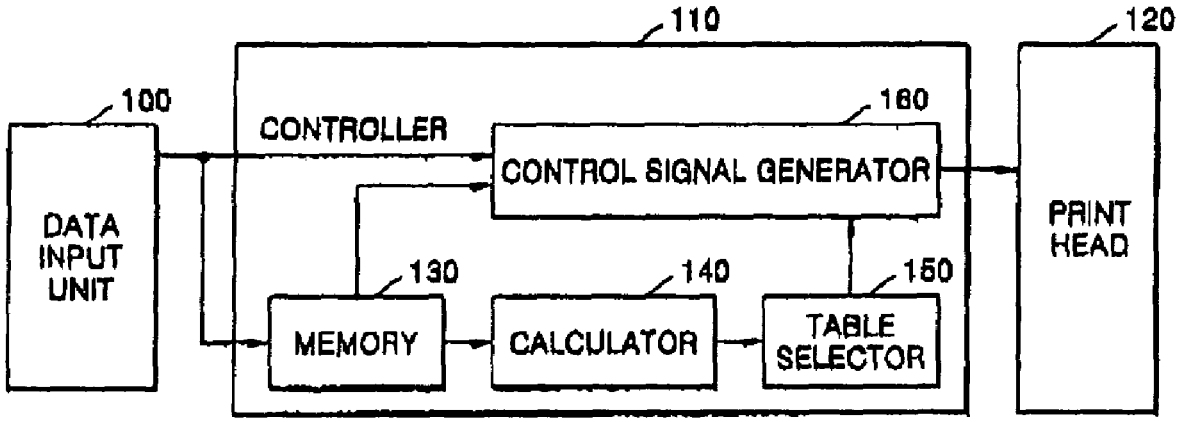
FIG. 1 is a block diagram illustrating components of an image forming device according to an embodiment of the present invention.

FIG. 1 is a block diagram illustrating components of an image forming device according to an embodiment of the present invention. The image forming device includes a data input unit 100, a controller 110, and a print head 120, wherein the controller 110 includes a control signal generator 160, a memory 130, a calculator 140, and table selector 150.

The data input unit 100 receives image data to be printed from a personal computer (PC), a digital camera, a personal digital assistant (PDA), or other devices.

The controller 110 generates signals to control an operation of the print head 120 depending on the input image data. The print head 120 receives the control signals from the controller 110, drives a plurality of recording elements, and prints an image on media.

Preferably print head 120 is an inkjet print head. Inkjet print heads have a plurality of nozzles for discharging ink with each nozzle corresponding to a dot to be printed. Each nozzle discharges ink to print an image using either piezoelectric elements in a piezoelectric type inkjet printer or heating elements in a heat-driven type inkjet printer. Further, it is preferable that the print head is a line-array head.

Figure 5:
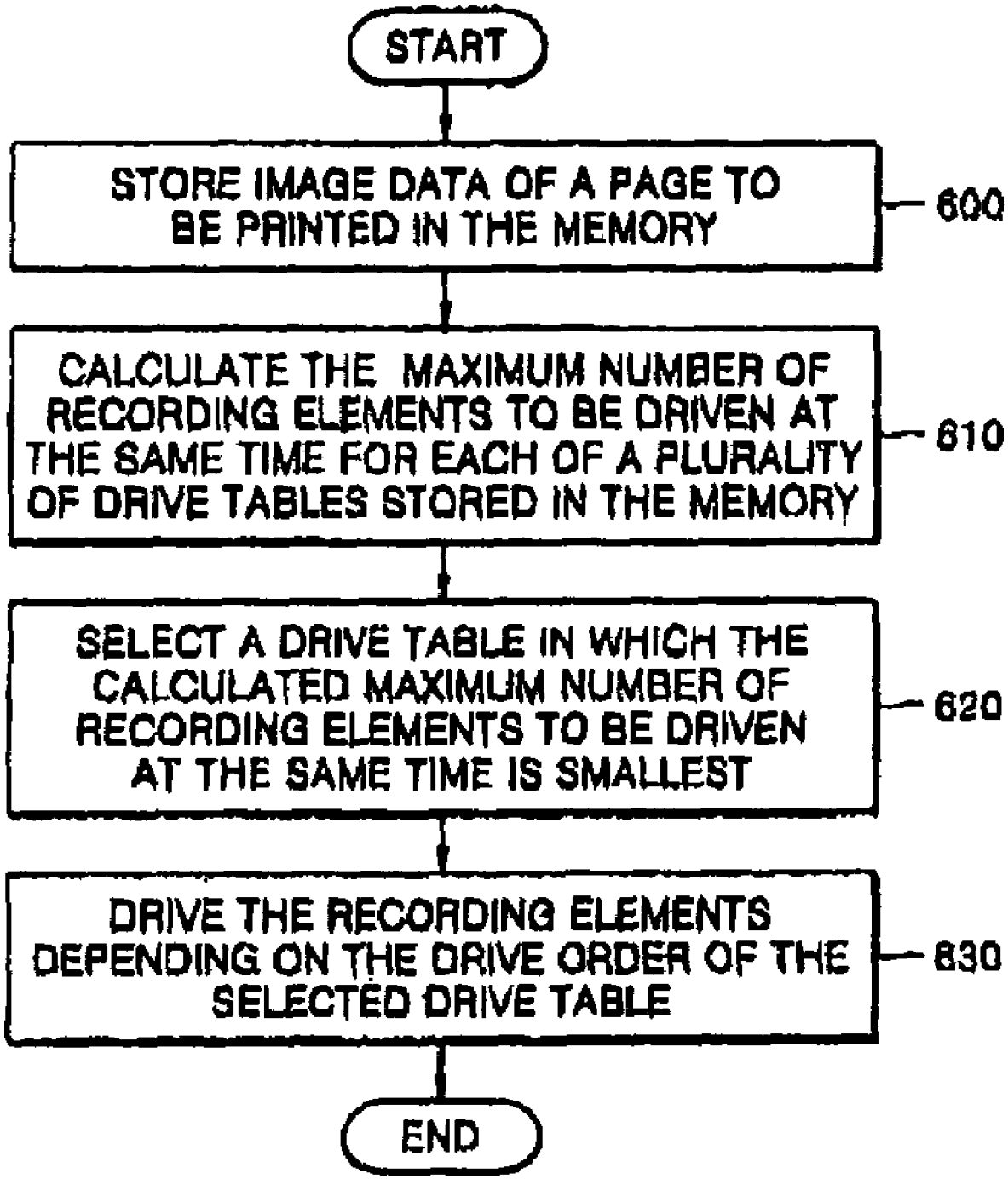
FIG. 5 is a flowchart illustrating a method of driving a print head according to an embodiment of the present invention.

According to an embodiment of the present invention shown in FIG. 5, an operation of the controller 110 in association with a flowchart illustrating another method of driving a print head will now be described.

Image data received from the data input unit 100 are stored in memory 130 by a page unit (operation 600). It is preferable to divide the recording elements into a plurality of drive groups and sequentially drive them when printing. Doing so results in less power consumption than simultaneously driving all of recording elements.

It is preferable that the memory 130 include a first memory storing image data for one page and a second memory storing two or more drive tables comprising information on the drive order of the recording components. Each of the drive tables comprises information about the drive order of the recording elements.

According to an embodiment of a method of driving nozzles of an inkjet print head, the drive order of the recording components stored in the drive tables will be described.

Preferably, a color inkjet print head having the resolution of 1200 dpi has about 40800 nozzles, and 40800 nozzles are divided into 120 drive groups. Consider an example of a line to be printed that requires 400 nozzles comprised of 100 nozzles for each of cyan C, magenta M, yellow Y, and black K colors that are divided into 20 drive groups. The drive order stored in the drive table will now be described.

Table 1 shows a first embodiment of the drive order stored in the drive table, wherein the nozzles are sequentially driven depending on the order of the drive group, and the nozzles belonging to the same drive group are simultaneously driven.

Further, the numbers indicated in each drive group shown in Table 1 indicates the nozzle numbers assigned to 100 nozzles. They range from 1 to 100 starting on the left side and depend on the order arranged in the inkjet print head.

TABLE 1

| | | | | | |
|---|---|---|---|---|---|
| first drive group | 1 | 21 | 41 | 61 | 81 |
| second drive group | 11 | 31 | 51 | 71 | 91 |
| third drive group | 6 | 26 | 46 | 66 | 86 |
| fourth drive group | 16 | 36 | 56 | 76 | 96 |
| fifth drive group | 2 | 22 | 42 | 62 | 82 |
| sixth drive group | 12 | 32 | 52 | 72 | 92 |
| seventh drive group | 7 | 27 | 47 | 67 | 87 |
| eighth drive group | 17 | 37 | 57 | 77 | 97 |
| ninth drive group | 3 | 23 | 43 | 63 | 83 |
| tenth drive group | 13 | 33 | 53 | 73 | 93 |
| eleventh drive group | 8 | 28 | 48 | 68 | 88 |

TABLE 1-continued

| | | | | | |
|---|---|---|---|---|---|
| twelfth drive group | 18 | 38 | 58 | 78 | 98 |
| thirteenth drive group | 4 | 24 | 44 | 64 | 84 |
| fourteenth drive group | 14 | 34 | 54 | 74 | 94 |
| fifteenth drive group | 9 | 29 | 49 | 69 | 89 |
| sixteenth drive group | 19 | 39 | 59 | 79 | 99 |
| seventeenth drive group | 5 | 25 | 45 | 65 | 85 |
| eighteenth drive group | 15 | 35 | 55 | 75 | 95 |
| nineteenth drive group | 10 | 30 | 50 | 70 | 90 |
| twentieth drive group | 20 | 40 | 60 | 80 | 100 |

According to the drive order shown in Table 1, the 11th, 31st, 51st, 71st, and 91st nozzles belong to the second drive group and are simultaneously driven after the nozzles in the first drive group. The drive order is determined so that the nozzles to be driven most are positioned as far apart as possible. Thus, when the 100 nozzles are to be used to print the line, nozzles belonging from the first drive group to the twentieth drive group are sequentially driven depending on the above order.

Figure 2:
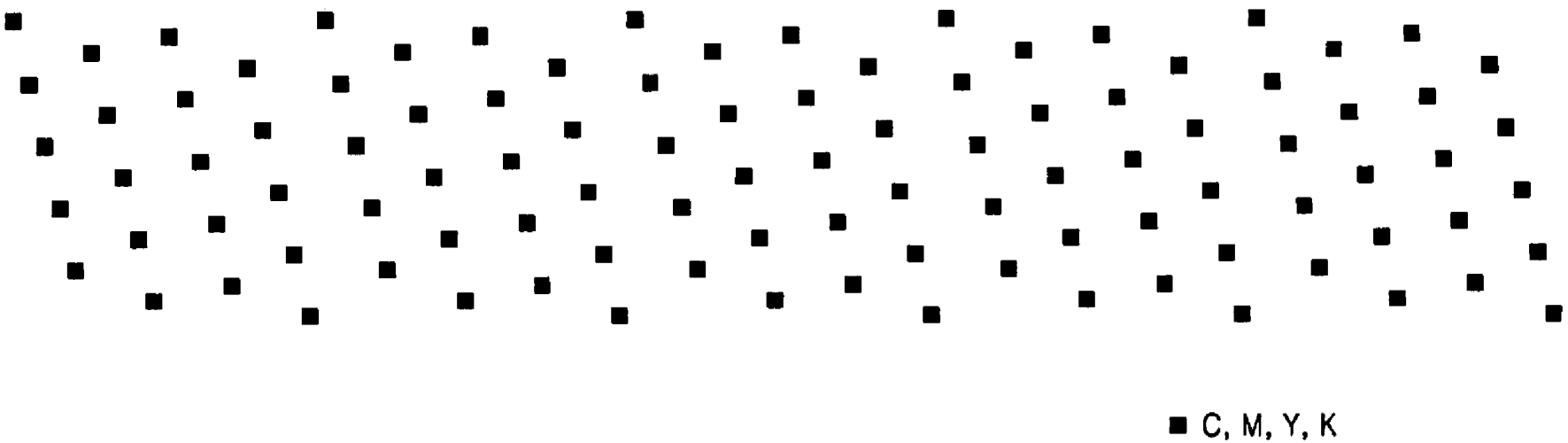
FIG. 2 is a diagram illustrating a first embodiment of a method of dividing a plurality of recording elements into 20 drive groups and sequentially driving them.

FIG. 2 shows one line to be printed in accordance with the drive order in Table 1 and shows that four nozzles, one for each of the colors C, M, Y, and K, are simultaneously used in order to print one dot consisting of the four colors. As shown in FIG. 2, a difference in printing position occurs based on in the differing times for driving the nozzles because the media is being moved while printing.

Five dots are printed if one drive group is driven when printing with C, M, Y, and K colors in the drive order shown in the FIG. 2. 20 nozzles belonging to each drive group can be simultaneously driven at maximum because four nozzles corresponding to four colors are simultaneously driven in order to print one dot.

Table 2 shows a second embodiment of the drive order stored in the drive table and shows two nozzles simultaneously driven to print C and Y colors and two nozzles simultaneously driven to print M, K colors, in order to sequentially drive a drive group to print one dot.

According to the operating order shown in Table 2, in the first drive group that is simultaneously driven comprises the 1st, 21st, 41st, 61st, and 81st nozzles printing the C and M colors and the 6th, 26th, 46th, 66th, and 86th nozzles printing the Y and K colors. Then, the nozzles belonging to the second drive group are simultaneously driven, including the 11th, 31st, 51st, 71st, and 91st nozzles printing the C and M colors and the 16th, 36th, 56th, 76th, and 96th nozzles printing the Y and K colors.

TABLE 2

| | | | | | | |
|---|---|---|---|---|---|---|
| first drive group | C, M | 1 | 21 | 41 | 61 | 81 |
| | Y, K | 6 | 26 | 46 | 66 | 86 |
| second drive group | C, M | 11 | 31 | 51 | 71 | 91 |
| | Y, K | 16 | 36 | 56 | 76 | 96 |
| third drive group | C, M | 6 | 26 | 46 | 66 | 86 |
| | Y, K | 1 | 21 | 41 | 61 | 81 |
| fourth drive group | C, M | 16 | 36 | 56 | 76 | 96 |
| | Y, K | 11 | 31 | 51 | 71 | 91 |
| fifth drive group | C, M | 2 | 22 | 42 | 62 | 82 |
| | Y, K | 7 | 27 | 47 | 67 | 87 |
| sixth drive group | C, M | 12 | 32 | 52 | 72 | 92 |
| | Y, K | 17 | 37 | 57 | 77 | 97 |
| seventh drive group | C, M | 7 | 27 | 47 | 67 | 87 |
| | Y, K | 2 | 22 | 42 | 62 | 82 |
| eighth drive group | C, M | 17 | 37 | 57 | 77 | 97 |
| | Y, K | 12 | 32 | 52 | 72 | 92 |
| ninth drive group | C, M | 3 | 23 | 43 | 63 | 83 |
| | Y, K | 8 | 28 | 48 | 68 | 88 |
| tenth drive group | C, M | 13 | 33 | 53 | 73 | 93 |

TABLE 2-continued

| | | | | | | |
|---|---|---|---|---|---|---|
| | Y, K | 18 | 38 | 58 | 78 | 98 |
| eleventh drive group | C, M | 8 | 28 | 48 | 68 | 88 |
| | Y, K | 3 | 23 | 43 | 63 | 83 |
| twelfth drive group | C, M | 18 | 38 | 58 | 78 | 98 |
| | Y, K | 13 | 33 | 53 | 73 | 93 |
| thirteenth drive group | C, M | 4 | 24 | 44 | 64 | 84 |
| | Y, K | 9 | 29 | 49 | 69 | 89 |
| fourteenth drive group | C, M | 14 | 34 | 54 | 74 | 94 |
| | Y, K | 19 | 39 | 59 | 79 | 99 |
| fifteenth drive group | C, M | 9 | 29 | 49 | 69 | 89 |
| | Y, K | 4 | 24 | 44 | 64 | 84 |
| sixteenth drive group | C, M | 19 | 39 | 59 | 79 | 99 |
| | Y, K | 14 | 34 | 54 | 74 | 94 |
| seventeenth drive group | C, M | 5 | 25 | 45 | 65 | 85 |
| | Y, K | 10 | 30 | 50 | 70 | 90 |
| eighteenth drive group | C, M | 15 | 35 | 55 | 75 | 95 |
| | Y, K | 20 | 40 | 60 | 80 | 100 |
| nineteenth drive group | C, M | 10 | 30 | 50 | 70 | 90 |
| | Y, K | 5 | 25 | 45 | 65 | 85 |
| twentieth drive group | C, M | 20 | 40 | 60 | 80 | 100 |
| | Y, K | 15 | 35 | 55 | 75 | 95 |

According to the operating order shown in Table 2, when the 400 nozzles are to be used to print the line, nozzles belonging from the first drive group to the twentieth drive group are sequentially driven.

As described above, the reason for simultaneously printing C and M colors, and Y and K colors is that it is less likely that they will be simultaneously printed. It is less likely because C and M colors, and Y and K colors are complementary pairs in terms of color relation to each other.

Figure 3:
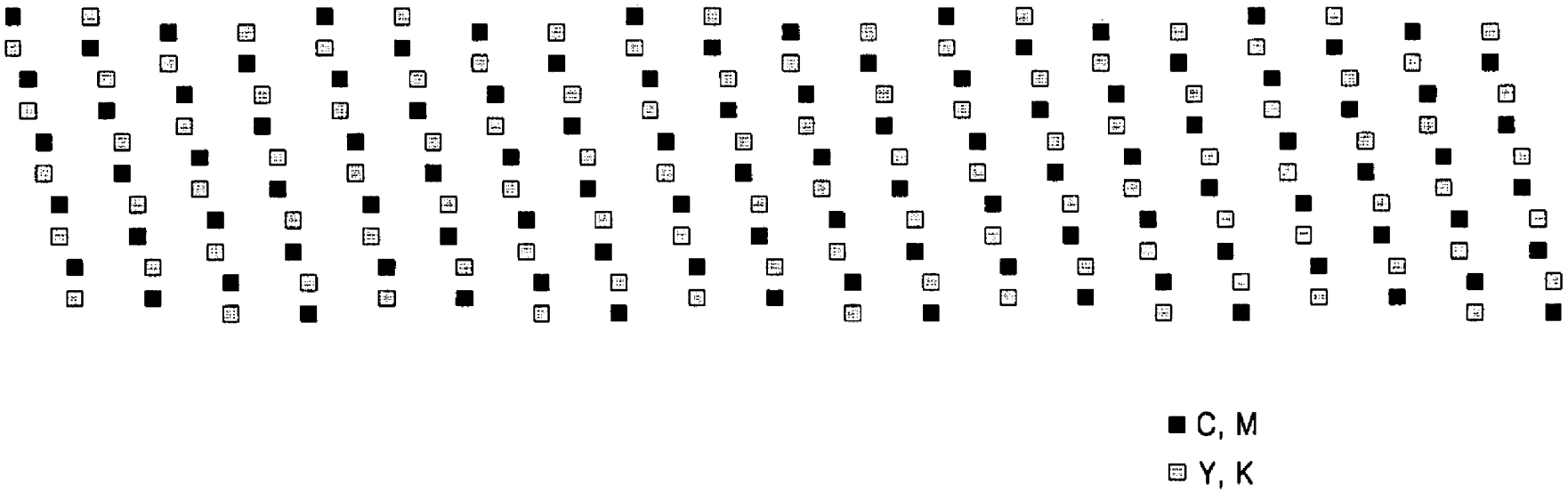
FIG. 3 is a diagram illustrating a second embodiment of a method of dividing a plurality of recording elements into 20 drive groups for each color and sequentially driving them.

FIG. 3 shows one line to be printed according to the operating order shown in Table 2 and shows driving nozzles to simultaneously print C and M colors and nozzles to simultaneously print Y and K colors, in order to print one dot with four colors of C, M, Y, and K.

TABLE 3

| | | | | | | |
|---|---|---|---|---|---|---|
| first drive group | C | 1 | 21 | 41 | 61 | 81 |
| | M | 11 | 31 | 51 | 71 | 91 |
| | Y | 6 | 26 | 46 | 66 | 86 |
| | K | 16 | 36 | 56 | 76 | 96 |
| second drive group | C | 11 | 31 | 51 | 71 | 91 |
| | M | 6 | 26 | 46 | 66 | 86 |
| | Y | 16 | 36 | 56 | 76 | 96 |
| | K | 1 | 21 | 41 | 61 | 81 |
| third drive group | C | 6 | 26 | 46 | 66 | 86 |
| | M | 16 | 36 | 56 | 76 | 96 |
| | Y | 1 | 21 | 41 | 61 | 81 |
| | K | 11 | 31 | 51 | 71 | 91 |
| fourth drive group | C | 16 | 36 | 56 | 76 | 96 |
| | M | 1 | 21 | 41 | 61 | 84 |
| | Y | 11 | 31 | 51 | 71 | 91 |
| | K | 6 | 26 | 46 | 66 | 86 |
| fifth drive group | C | 2 | 22 | 42 | 62 | 82 |
| | M | 12 | 32 | 52 | 72 | 92 |
| | Y | 7 | 27 | 47 | 67 | 87 |
| | K | 17 | 37 | 57 | 77 | 97 |
| sixth drive group | C | 12 | 32 | 52 | 72 | 92 |
| | M | 7 | 27 | 47 | 67 | 87 |
| | Y | 17 | 37 | 57 | 77 | 97 |
| | K | 2 | 22 | 42 | 62 | 84 |
| seventh drive group | C | 7 | 27 | 47 | 67 | 87 |
| | M | 17 | 37 | 57 | 77 | 97 |
| | Y | 2 | 22 | 42 | 62 | 82 |
| | K | 12 | 32 | 52 | 72 | 92 |
| eighth drive group | C | 17 | 37 | 57 | 77 | 97 |
| | M | 2 | 22 | 42 | 62 | 82 |
| | Y | 12 | 32 | 52 | 72 | 92 |
| | K | 7 | 27 | 47 | 67 | 87 |
| ninth drive group | C | 3 | 23 | 43 | 63 | 83 |
| | M | 13 | 33 | 53 | 73 | 93 |
| | Y | 8 | 28 | 48 | 68 | 88 |

TABLE 3-continued

| | | | | | | |
|---|---|---|---|---|---|---|
| | K | 18 | 38 | 58 | 78 | 98 |
| tenth drive group | C | 13 | 33 | 53 | 73 | 93 |
| | M | 8 | 28 | 48 | 68 | 88 |
| | Y | 18 | 38 | 58 | 78 | 98 |
| | K | 3 | 23 | 43 | 63 | 83 |
| eleventh drive group | C | 8 | 28 | 48 | 68 | 88 |
| | M | 18 | 38 | 58 | 78 | 98 |
| | Y | 3 | 23 | 43 | 63 | 83 |
| | K | 13 | 33 | 53 | 73 | 93 |
| twelfth drive group | C | 18 | 38 | 58 | 78 | 98 |
| | M | 2 | 23 | 43 | 63 | 83 |
| | Y | 13 | 33 | 53 | 73 | 93 |
| | K | 8 | 28 | 48 | 68 | 88 |
| thirteenth drive group | C | 4 | 24 | 44 | 64 | 84 |
| | M | 14 | 34 | 54 | 74 | 94 |
| | Y | 9 | 29 | 49 | 69 | 89 |
| | K | 19 | 39 | 59 | 79 | 99 |
| fourteenth drive group | C | 14 | 34 | 54 | 74 | 94 |
| | M | 9 | 29 | 49 | 69 | 89 |
| | Y | 19 | 39 | 59 | 79 | 99 |
| | K | 4 | 24 | 44 | 64 | 84 |
| fifteenth drive group | C | 9 | 29 | 49 | 69 | 89 |
| | M | 19 | 39 | 59 | 79 | 99 |
| | Y | 4 | 24 | 44 | 64 | 84 |
| | K | 14 | 34 | 54 | 74 | 94 |
| sixteenth drive group | C | 19 | 39 | 59 | 79 | 99 |
| | M | 4 | 24 | 44 | 64 | 84 |
| | Y | 14 | 34 | 54 | 74 | 94 |
| | K | 9 | 29 | 49 | 69 | 89 |
| seventeenth drive group | C | 5 | 25 | 45 | 75 | 95 |
| | M | 15 | 35 | 55 | 75 | 95 |
| | Y | 10 | 30 | 50 | 70 | 90 |
| | K | 20 | 40 | 60 | 80 | 100 |
| eighteenth drive group | C | 15 | 35 | 55 | 75 | 95 |
| | M | 10 | 30 | 50 | 70 | 90 |
| | Y | 20 | 40 | 60 | 80 | 100 |
| | K | 5 | 25 | 45 | 65 | 85 |
| nineteenth drive group | C | 10 | 30 | 50 | 70 | 90 |
| | M | 20 | 40 | 60 | 80 | 100 |
| | Y | 5 | 25 | 45 | 65 | 85 |
| | K | 15 | 35 | 55 | 75 | 95 |
| twentieth drive group | C | 20 | 40 | 60 | 80 | 100 |
| | M | 5 | 25 | 45 | 65 | 85 |
| | Y | 15 | 35 | 55 | 75 | 95 |
| | K | 10 | 30 | 50 | 70 | 90 |

Table 3 shows a third embodiment of the drive order stored in the drive table and shows driving four nozzles to print C, M, Y, and K colors, the nozzle of each color at a different time, in order to print one dot.

According to the drive order of Table 2, simultaneously driven first are the 21st, 41st, 61st, and 81st nozzles printing the C color; the 11th, 31st, 51st, 71st, and 91st nozzles printing the M color; the 6th, 26th, 46th, 66th, and 86th nozzles printing the Y color; and the 16th, 36th, 56th, 76th, and 96th nozzles printing the K color.

Then, the nozzles belonging to the second drive group are driven, including the 11th, 31st, 51st, 71st, and 91st nozzles among nozzles printing the C color; the 6th, 26th, 46th, 66th, and 86th nozzles printing the M color; the 16th, 36th, 56th, 76th, and the 96th nozzle among nozzles to print Y color, the 1st nozzle, the 21st nozzle, the 41st nozzle, the 61st nozzle, and the 81st nozzles among nozzles to print K color are driven.

According to the drive order shown in Table 3, nozzles belonging to from the first drive group to the twentieth drive group are sequentially driven, whereby all 400 nozzles are driven and one line is printed.

Figure 4:
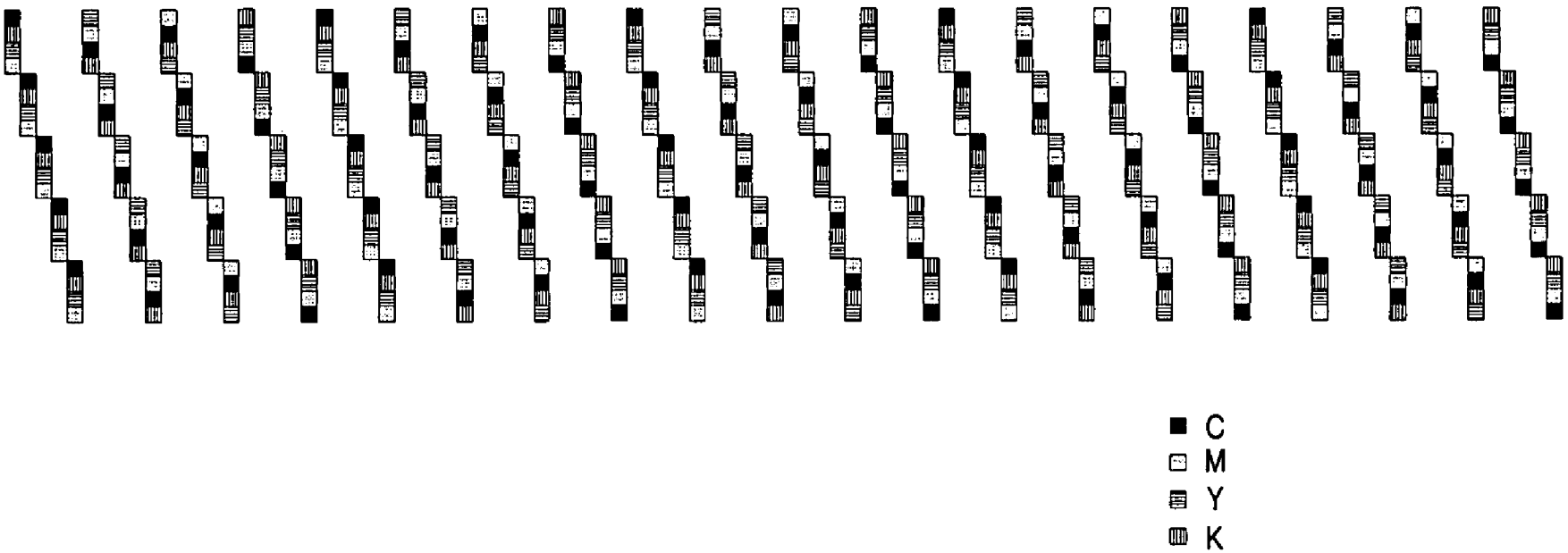
FIG. 4 is a diagram illustrating a third embodiment of a method of dividing a plurality of recording elements into 20 drive groups for each color and sequentially driving them.

FIG. 4 shows one line to be printed depending on the drive order shown in the Table 3. FIG. 4 shows the result of driving four nozzles, each to print the C, M, Y, and K colors at a different time, in order to print one dot with the four colors of C, M, Y, and K.

The calculator 140 receives image data on one page from the memory 130 and calculates the maximum number of the recording elements to be simultaneously driven when printing the image data. The calculation is performed by driving the recording elements according to the information on the drive order in the drive table for each of drive tables stored in the memory 130 (operation 610).

The table selector 150 selects the drive table from among the plurality of drive tables which has the smallest maximum number of the recording elements to be simultaneously driven, and outputs information about the selected drive table (operation 620).

The control signal generator 160 receives information about the selected drive table from the table selector 150 and reads the drive table from the memory 130. Then, the control signal generator 160 generates and outputs control signals to control operation of the print head 120 depending on information about the drive order of the read drive table. The print head 120 then drives the recording elements depending on the control signals and prints an image (operation 630).

The image forming device further includes a group decision unit (not shown), whereby it preferably allows the recording elements to be driven by increasing the number of the drive groups when the maximum number of the recording element to be driven in the selected drive table exceeds a fixed number (n).

If the number of the drive groups increases, the number of nozzles to be simultaneously driven decreases, but the amount of time it takes to print one line increases. Therefore, the print head frequency should be also adjusted in accordance with the increase in the amount print time. For example, if the number of the drive groups increases from 120 to 240, a print head frequency of 20 Khz should be adjusted to 10 Khz.

The invention can also be embodied as computer readable code stored on a computer readable recording medium. The computer readable recording medium is any data storage device that can store data which can thereafter be read by a computing system. Examples of a computer readable recording medium include Read-Only Memory (ROM), Random Access Memory (RAM), Compact Disk-Random Access. Memory (CD-ROM), magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, codes, and code segments for accomplishing an embodiment of the present invention can be easily construed by programmers skilled in the art to which the present embodiments of invention pertains.

As described above, in a method of driving a print head according to an embodiment of the present invention and an image forming device employing the method, it is possible to drive a print head with reduced power consumption while not being significantly influenced by the characteristics of an image to be printed and thus stably drive the power supply device. This can be done by selecting drive tables among a plurality of drive tables having the lowest electric power consumption depending on the image data to be printed and then driving the recording elements through the selected drive tables. Each of the drive tables having information about the drive order of the recording elements.

While the invention has been shown and described with reference to certain embodiments thereof, it will be understood by those skilled in the art that various changes in form and details may be made therein without departing from the spirit and scope of the invention as defined by the appended claims.

What is claimed is:

1. A method of driving a print head that prints an image on media by dividing a plurality of recording elements of the print head into N number of drive groups and sequentially driving the N groups of recording elements, the method comprising:

obtaining, for each of a plurality of drive tables, a maximum number of recording elements to be simultaneously driven when printing the image, according to a drive order in each of the plurality of drive tables, each drive table comprising drive order information about the order of driving the recording elements;

selecting the drive table of the plurality of tables in which the obtained maximum number of the recording elements to be simultaneously driven is smallest; and driving the recording elements using the selected drive table.

2. The method according to claim 1, wherein the print head comprises a line array head.

3. The method according to claim 1, wherein the recording elements prints an image by ejecting ink onto the media.

4. The method according to claim 1, wherein at least one of the plurality of drive tables comprises a drive table having drive order information for driving the recording elements so that a distance between adjacent recording elements to be simultaneously driven becomes N times further than a distance between adjacent recording elements.

5. The method according to claim 1, wherein at least one of the plurality of drive tables comprises a drive table having drive order information so that at different times four recording elements are driven to print respective cyan C, magenta M, yellow Y, and black K colors in the same printing position.

6. The method according to claim 1, wherein at least one of the plurality of drive tables comprises a drive table having drive order information so that in the same printing position two recording elements are simultaneously driven to each print cyan C and magenta M colors and another two recording elements are simultaneously driven to each print yellow Y and black K colors.

7. The method according to claim 1, further comprising increasing the number N of the drive groups when the maximum number of recording elements to be simultaneously driven in the selected drive table exceeds a predetermined number.

8. A computer program embodied on a computer readable medium for driving a print head that prints an image on media by dividing a plurality of recording elements of the print head into N number of drive groups and sequentially driving the N groups of recording elements, comprising:

an obtaining source code segment for obtaining, for each of a plurality of drive tables, a maximum number of recording elements to be simultaneously driven when printing the image, according to a drive order in each of the plurality of drive tables, each drive table comprising drive order information about the order of driving the recording elements;

a selecting source code segment for selecting the drive table of the plurality of tables in which the obtained maximum number of the recording elements to be simultaneously driven is smallest; and a driving source code segment for driving the recording elements using the selected drive table.

9. An image forming apparatus which prints an image by dividing a plurality of recording elements of a print head into N number of drive groups and sequentially driving the N groups of recording elements, the apparatus comprising:

a data input unit for receiving image data to be printed; and a controller for generating and outputting control signals for dividing the recording elements into the N number of drive groups and sequentially driving the N groups of recording elements, depending on the input data;

the print head having the plurality of recording elements for printing an image on media by driving the recording elements according to the control signals, wherein the controller comprises:

a memory storing a plurality of drive tables having drive order information about the order of driving the recording elements and image data;

a calculator reading the image data from the memory and calculating, for each of the plurality of drive tables, a maximum number of recording elements to be simultaneously driven when printing the image, according to the drive order in each of the plurality of drive tables stored in the memory; and a table selector selecting a drive table in which the calculated maximum number is the smallest.

10. The image forming device according to claim 9, wherein the print head comprises a line array head.

11. The image forming device according to claim 9, wherein the recording elements print an image by ejecting ink onto the media.

12. The image forming device according to claim 9, wherein at least one of the plurality of drive tables comprises a drive table having drive order information for driving the recording elements so that a distance between adjacent recording elements to be simultaneously driven becomes N times further than a distance between adjacent recording elements.

13. The image forming device according to claim 9, wherein at least one of the plurality of drive tables comprises a drive table having drive order information so that at different times four recording elements are driven to print respective cyan C, magenta M, yellow Y, and black K colors in the same printing position.

14. The image forming device according to claim 9, wherein at least one of the plurality of drive tables comprises a drive table having drive order information so that in the same printing position two recording elements are simultaneously driven to each print cyan C and magenta M colors and another two recording elements are simultaneously driven to each print yellow Y and black K colors.

15. The image forming device according to claim 9, further comprising a group decision unit for increasing the number N of the drive groups when the maximum number of recording elements to be simultaneously driven in the selected drive table exceeds a predetermined number.

* * * * *